US006171045B1

(12) United States Patent
Nehring et al.

(10) Patent No.: US 6,171,045 B1
(45) **Date of Patent: *Jan. 9, 2001**

(54) DEVICE FOR BACKING BOOK BLOCKS

(75) Inventors: Dieter Nehring, Bad Oeynhausen; Christoph Schmücker, Rahden, both of (DE)

(73) Assignee: Kolbus GmbH & Co. KG, Rahden (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/467,572

(22) Filed: Dec. 20, 1999

(30) Foreign Application Priority Data

Dec. 22, 1998 (DE) ..... 198 59 331

(51) Int. Cl.[7] ..... B42C 5/02
(52) U.S. Cl. ..... 412/30
(58) Field of Search ..... 412/25, 29, 30, 412/31, 32, 20

(56) References Cited

U.S. PATENT DOCUMENTS 1,195,679 * 8/1916 Hill ..... 412/30
4,747,740 * 5/1988 Rahe ..... 412/30
5,658,111 * 8/1997 Rathert ..... 412/30

FOREIGN PATENT DOCUMENTS 36 14 168 10/1987 (DE) .
0 676 303 A1 10/1995 (EP) .

* cited by examiner

*Primary Examiner*—Willmon Fridie, Jr.
(74) *Attorney, Agent, or Firm*—Alix, Yale & Ristas, LLP

(57) ABSTRACT

A device for the mechanical pressing of rounded book blocks held clamped in the region near the back is presented. The device includes a molding tool, which acts upon the book block back with a pressing force. A carriage is provided which receives the molding tool and is pivotable onto alternate sides of the book block back via a drive disposed on curved tracks in oppositely arranged, vertically displaceable bearings. The traveled radius of the active surface of the molding tool is smaller than the radius of the book block back and a tangential tensile/thrust component acting upon the lateral regions of the book block back in order to bend the printed sheets over is imparted thereon. A drive for lowering the molding tool onto the book block back and for raising the molding tool for the return stroke into the central position is provided in order to optimize the pressing process and to reduce the structural outlay and to reduce the setup time. The molding tool is vertically displaceable in the carriage via an operating cylinder which can be actuated by compressed air. The pressing force is adjustable via the compressed air and is controlled in such a manner that, in the central position, the molding tool acts upon the back of the book block with a pressing force which is reduced in relation to the pressing force applied in the pivoting position.

42 Claims, 3 Drawing Sheets

DEVICE FOR BACKING BOOK BLOCKS

BACKGROUND OF THE INVENTION

1. Field of the Invention

The invention relates to a device for the mechanical pressing of rounded book blocks and, more particularly, a device for the mechanical pressing of book blocks including a molding tool that applies a variable pressing force to the back of a book block.

2. Description of Related Art

In industrial book production, a book block with a rounded back receives the desired back shape corresponding to the cover type in the pressing processing station. The back shape being determined by a deep or flat fold. The pressing is effected by a molding tool, which is reciprocated over the entire width of the back of the book block and comprises a concave active surface, so that by applying pressure and friction, the folded printed sheets are bent over on both sides from the center of the book block back, namely at an angle increasing towards the outside. In this manner, the book block receives its mushroom-like shape and at the same time a back stabilization. In order to effect the pressing procedure, the book block is clamped between pressing strips with a defined overhang of the rounding end.

In European Patent 0,676,303, which is assigned to the present assignee hereof, in addition to a number of embodiments, a device for the mechanical pressing of book blocks of the construction described above is disclosed. By displacing the bearing with the carriage and the molding tool between the fixed lateral guides, the lateral deflection of the bearing is dispensed with. The axis of rotation of the molding tool lies at a defined distance below its point of contact with the back of the book block. The molding tool moves tangentially and overlies the pivoting axis. By means of stop screws in an intermediate support, the displacement is limited and in this manner the sliding movement is introduced into the lateral region in order to fold over the printed sheets. The size of the displacement stroke can be adjusted by varying the distance of the axis of rotation of the molding tool from the book block back and via the stop screws.

SUMMARY OF THE INVENTION

An object of the present invention is to overcome the above described disadvantages of the prior art.

Another object is to optimize the pressing process of rounded book blocks while also increasing the quality thereof.

It is a further object to provide a flexible device which readily adapts to various materials and back shapes of the book block and wherein the structural outlay and time required for setting up are to be reduced.

The foregoing objects and other objects are achieved according to an embodiment of the invention wherein a molding tool is vertically displaceable in a carriage via an operating cylinder which can be actuated by compressed air. The pressing force of the molding tool is adjustable via the compressed air and is controlled in such a manner that, within a central position, the molding tool acts upon the back of the book block with a pressing force which is reduced in relation to the pressing force in the pivoting position. In this respect, the molding tool can be displaced in the carriage by a computer-controlled sequence into a vertical position in which it is lowered onto the back of the book block and into another vertical position in which it is raised from the back of the book block. It has proved particularly expedient that the molding tool can be lowered onto the back of the book block for locating in the central position, and the pressing force can be adjusted by means of the operating cylinder actuated by a particular pressure.

As a result of the use of compressed air cylinders to control the molding tool, the pressing force on the book block back can be optimally adjusted via compressed air as a function of the materials of the book block. Also, the pressing force can be controlled in such a manner that the molding tool when in a central position only acts with a low pressing force upon the book block back, which has a protective effect on the book block, since excessive compression of the printed sheets located in the center is prevented. In the case of extremely delicate materials of the book block, the pressing force in the central position of the molding tool can also be significantly reduced. By compression of compressed air columns, a sharp increase in the force in the normal direction is attained in the lateral end positions, and with the stroke of the molding tool the tensile/thrust components are generated for bending over the printed sheets. This optimization of the pressing process results in an improvement in the quality of the book blocks.

By means of simple linear guidance in connection with a spindle drive, the pressing head with the molding tool can be lowered in a motor driven manner onto the book block back to a defined vertical position and the central position of the book block back in order to effect a location measurement. Using the measurement result of the piston displacement during its stroke in the pneumatic cylinder, the pressing head is automatically adjusted to a corrected vertical position, so that compensation for the different back rounding and fold widths can be carried out. The respective vertical positions in the end position of the molding tool in the central position and pivoting position for the pressing and for the load-free return stoke are reached in a computer-controlled manner. The pressing force can be adjusted during the measurement as a function of the materials of the book block.

Molding tools with differently shaped radii of the active surface are largely dispensed with in the pressing device according to the invention. Finally, the new type of pressing device can be set up in a problem-free manner in minimal time.

BRIEF DESCRIPTION OF THE DRAWINGS

An embodiment of the invention will be explained in further detail with the aid of the accompanying Figures, in which.

DETAILED DESCRIPTION OF THE PREFERRED EMBODIMENTS

The following applications have been filed contemporaneously herewith and each of which are incorporated herein by reference. U.S. Patent Application entitled "Device For The Back Rounding Of Book Blocks", U.S. Application No.

09/468,149; U.S. Patent Application entitled "A Device For Rounding And Backing Book Blocks", U.S. Application No. 09/470,484; U.S. Patent Application entitled "A Book Production Line", U.S. Application No. 09/470,617.

Figure 1:
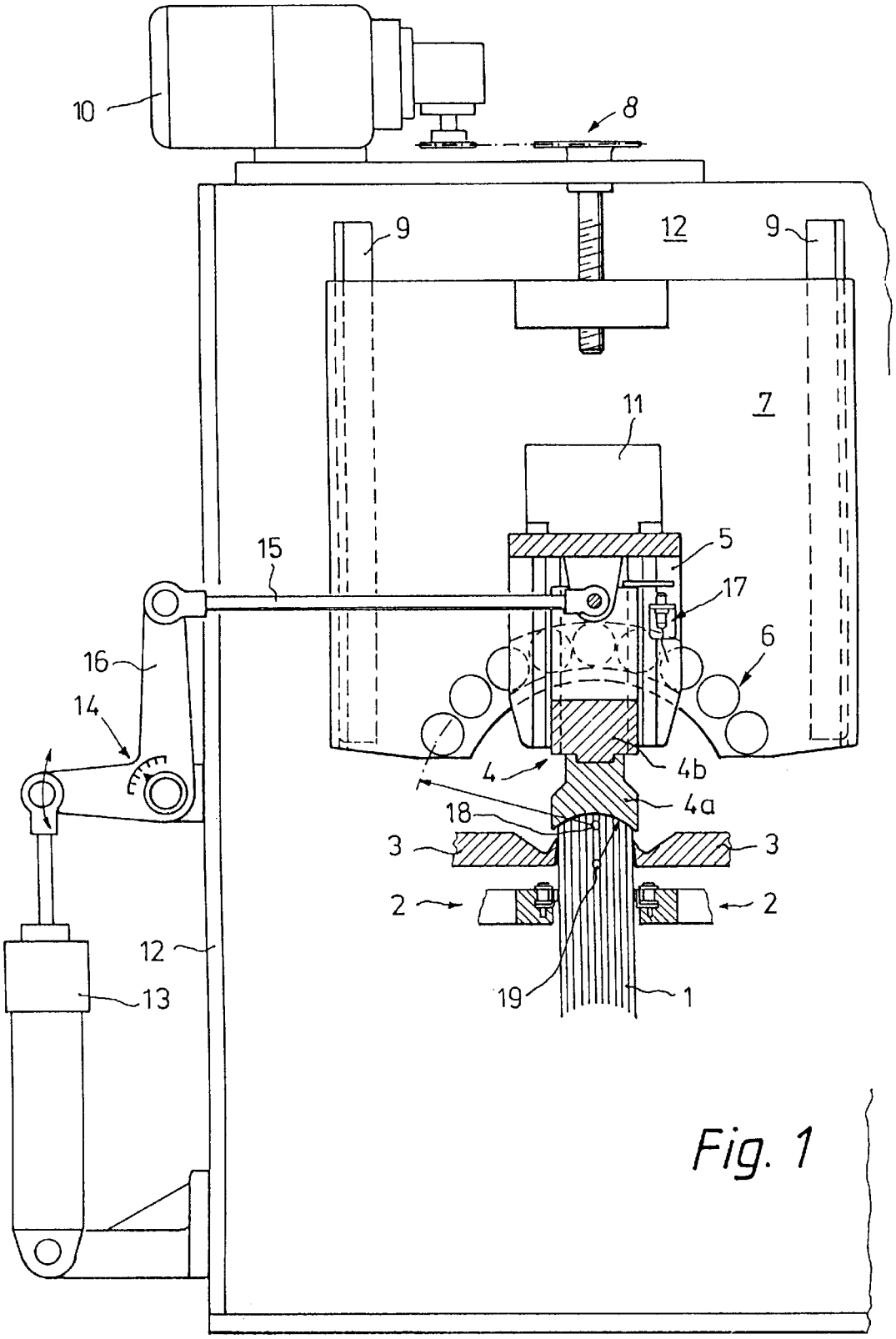
FIG. 1 is a sectional view taken along lines 1—1 of FIG. 2 showing a pressing station of a book block rounding and pressing machine in accordance with one embodiment of the present invention.

Referring to FIG. 1, in a book block rounding and pressing machine, the book blocks 1, following the back rounding process, enter a pressing station, in which a book block with a rounded back receives a back shape which is determined by a deep or flat fold in a known manner. The book blocks 1, clamped by support chains 2, are received by pressing jaws 3 and during the pressing process are held spaced from and with a defined overhang of the rounded end.

The pressing is effected in a known manner by a molding tool 4, which is reciprocated over the entire width of the back of the book block 1. The molding tool 4 comprises a replaceable molding section 4*a* with a particular concave active surface and a support 4*b*. By using pressure and friction, the folded printed sheets of the book block 1 are bent over on both sides from the center of the book block back, namely at an angle increasing towards the outside.

Figure 2:
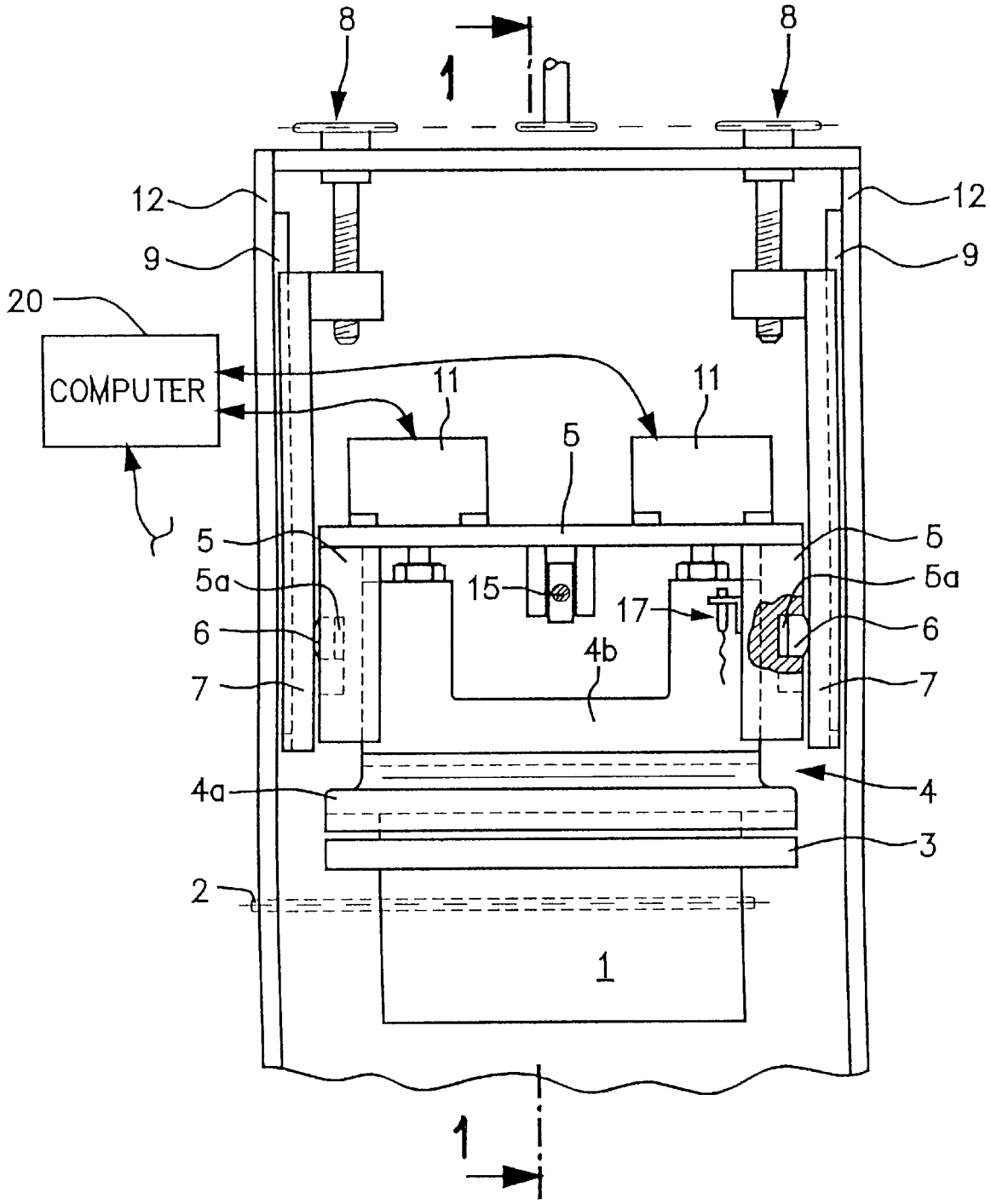
FIG. 2 is a side view of the pressing station and a computer in accordance with one embodiment of the present invention.

Referring now also to FIG. 2, the molding tool 4 is vertically displaceable and is arranged in a bridge-like carriage 5 with tracks 5*a* being curved at the ends thereof. The tracks engage freely rotatable and correspondingly curved roller tracks 6 engaged with lateral bearings 7. The lateral bearings 7 can be vertically displaced on guide tracks 9 on the machine frame 12 via spindle adjustments 8 which may be driven by a motor 10.

According to the invention, the molding tool 4 is vertically displaced in the carriage 5 via two spaced apart operating cylinders 11, which may be actuated by compressed air. By means of the pressure in the operating cylinders 11, the pressing force acting upon the book block back may be adjusted and controlled in such a manner that the molding tool 4, located in a central position along the book block back as shown in FIG. 1 acts upon the book block back with a low pressing force and when in a pivoting position with a high pressing force. As a result of the position of the center of rotation 18 of the molding tool 4 and the center of circle 19 of the book block back, the traveled radius of the active surface of the molding tool 4 is smaller than the radius of the book block back. As illustrated, the molding tool 4 can be deflected in a radial direction relative to the curved roller tracks 6. When valves (not shown) located in the upper chamber of the operating cylinders 11 are blocked, the pressure and the force acting upon the book block back increases. In the combination with the movement of the molding tool 4, a tensile/thrust component acting tangentially on the lateral regions of the book block back is generated in order to bend over the printed sheets, resulting in a marked mushroom-like deformation of the book block back. As a result of the compression of the air, a sharp rise in the pressing force is attained in the end positions.

Once the pivoting movement has been carried out, the molding tool 4 lifts from the book block back for the return stroke into the central position. To this end, the pressure in the upper chamber of the operating cylinders 11 is reduced to zero bar by opening the valves and at the same time a defined pressure is built up in the lower chamber of the operating cylinders 11. Once the molding tool 4 has reached the central position as the starting position for the pressing, the pressure build-up in the upper chamber of the operating cylinders 11 is again effected for the pressing process, while the pressure in the lower chamber of the operating cylinders 11 is reduced to zero bar by opening the valves.

The displacement of the molding tool 4 into the position engaging the book block back in the central position via the operating cylinders 11 actuated by a pre-adjusted air pressure as well as into the position raised from the book block back in the pivoted position for the load-free return stroke and for supplying the book blocks 1 may be effected via a control computer 20 with appropriate software or firm ware.

The pivoting movement of the carriage 5 with the molding tool 4 is effected by a hydraulic cylinder 13 and the pivoting angle is adjustable as a function of the book block thickness via, e.g., stored values accessed by the computer in connection with an incremental transmitter 14. The force transmission is effected via a coupling rod 15 connected in articulated fashion to the carriage 5 and an angle lever 16. The angle lever 16 is fixedly mounted on the machine frame 12 and articulatedly interconnects the coupling rod 15 and the piston rod of the hydraulic cylinder 13.

Figures 3A, 3B, 3C:
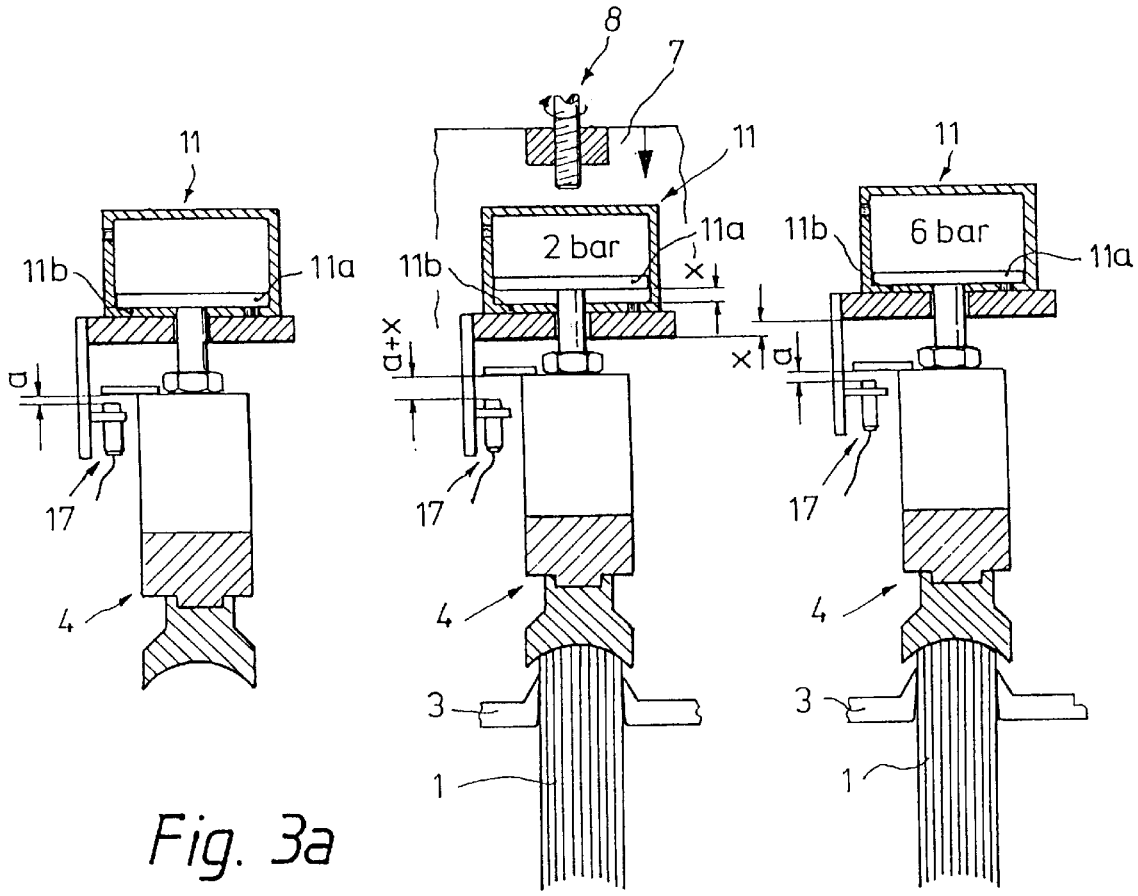
FIGS. 3*a–c* illustrate a sequence of locating a molding tool of the pressing station at a particular height in accordance with an embodiment of the present invention.

With reference to FIGS. 3*a–c*, the sequence of locating the molding tool 4 with the aid of a single operating cylinder 11 will now be explained. For location to a defined height, the molding tool 4 is arranged in the central position and a pressure of, for example, about two bar is provided by the operating cylinder 11 as a function of the particular book block. With the aid of an electronic distance measuring system 17 in the form of an analogue inductive receiver such as an inductive proximity sensor, a distance a is determined as a reference value. By means of spindle adjustments 8, a lowering of the molding tool 4 onto the book block back is effected by displacing the entire pressing head in the machine frame 12 and the piston 11*a* is thereby lifted from the cylinder floor 11*b* by a distance x as the molding tool 4 is placed onto the book block back. The new vertical position of the molding tool 4 as determined in this manner is supplied by the distance measuring system 17 as an electronic value to the control computer 20. Next, via the motor-driven spindle adjustment 8, a lifting of the operating cylinder 11 by the distance x is effected after switching over the direction of rotation of the motor 10 (FIG. 1), until the piston 11*a* contacts the cylinder floor 11*b*. In this manner, it is ensured that a pressing force corresponding to a pressure of only about two bar acts upon the book block back. As shown in FIG. 3*c*, the molding tool 4 is now in the measured new vertical position as a starting position for the pressing process. Subsequently, the pressure in the operating cylinder 11 is increased to six bar, for example, which does not, however, act upon the central position of the book block back, since the cylinder floor 11*b* absorbs most of the force and a path limitation is hereby effected. Consequently, the molding tool 4 in the central position acts upon the book block back with a low pressing force and when the molding tool 4 is pivoted (FIG. 1) into a pivoted position a high pressing force, which increases towards the lateral edges of the book block, is applied. This variation in pressing force optimizes placement thereof on the book blocks 1 and results in an increase in the quality of the book blocks.

Differences in the size of back rounding and fold widths can be compensated for by using the automatic adjustment of the molding tool 4 via measuring piston displacement.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. A device for the mechanical pressing of rounded book blocks held by a support and each of the book blocks having printed sheets and a back including a center and lateral regions, comprising:

drive means;

curved tracks disposed in oppositely arranged, vertically displaceable bearings;

a carriage engageable with the curved tracks and the drive means, the carriage being pivotable from a central position axially aligned with the book block back to alternate sides of the book block back via the drive means;

a molding tool supported by the carriage and being pivotable therewith, the molding tool being actuable to apply a pressing force to the book block back, wherein a traveled radius of the active surface of the molding tool is smaller than a radius of the book block back and the molding tool applying a tangential tensile/thrust component acting upon the lateral regions of the book block back in order to bend the printed sheets over;

means for lowering carriage such that the molding tool is located at a central position of the book block back and for raising the molding tool therefrom;

at least one operating cylinder actuatable for vertically displacing the molding tool in the carriage, and the pressing force of the molding tool being adjustable via pressure from the operating cylinder;

wherein the at least one operating cylinder is controlled in such a manner that, when in the central position, the molding tool acts upon the back of the book block with a pressing force which is less than the pressing force applied when the molding tool is in a pivoted position.

2. The device according to claim 1 further comprising a computer for controlling the sequence for displacing the molding tool in the carriage between a vertical position in which the molding tool is lowered onto the back of the book block and into another vertical position in which the molding tool is raised from the back of the book block.

3. The device according to claim 1, wherein the pressing force of the molding tool is adjustable by the operating cylinder actuated by a predefined pressure depending on the particular book block to be pressed.

4. The device according to claim 2, wherein the pressing force of the molding tool is adjustable by the operating cylinder actuated by a predefined pressure depending on the particular book block to be pressed.

5. The device according to claim 3, further comprising a measuring system for measuring the displacement of the piston of the operating cylinder for adjusting the pressing force.

6. The device according to claim 4, further comprising a measuring system for measuring the displacement of the piston of the operating cylinder for adjusting the pressing force.

7. A device according to claim 1 wherein the curved tracks of the carriage are interconnected with the molding tool and further comprising:

roller tracks engageable with the curved tracks;

lateral bearings interconnected with the roller tracks;

a drive device; and vertical guides receiving the lateral bearings for vertical displacement of the carriage via the drive device.

8. A device according to claim 2 wherein the curved tracks of the carriage are interconnected with the molding tool and further comprising:

roller tracks engageable with the curved tracks;

lateral bearings interconnected with the roller tracks;

a drive device; and vertical guides receiving the lateral bearings for vertical displacement of the carriage via the drive device.

9. A device according to claim 3 wherein the curved tracks of the carriage are interconnected with the molding tool and further comprising:

roller tracks engageable with the curved tracks;

lateral bearings interconnected with the roller tracks;

a drive device; and vertical guides receiving the lateral bearings for vertical displacement of the carriage via the drive device.

10. A device according to claim 5 wherein the curved tracks of the carriage are interconnected with the molding tool and further comprising:

roller tracks engageable with the curved tracks;

lateral bearings interconnected with the roller tracks;

a drive device; and vertical guides receiving the lateral bearings for vertical displacement of the carriage via the drive device.

11. The device according to claim 1 wherein:

the operating cylinder for bending over the printed sheets in the lateral regions of the back of the book block is actuated by a predefined pressure of the operating cylinder and the operating cylinder including a piston; and the pressing force is adjustable by a path limitation of the piston in the operating cylinder by raising the operating cylinder into a vertical position determined by locating the molding tool at a predetermined height from the back of the book block.

12. The device according to claim 2 wherein:

the operating cylinder for bending over the printed sheets in the lateral regions of the back of the book block is actuated by a predefined pressure of the operating cylinder and the operating cylinder including a piston; and the pressing force is adjustable by a path limitation of the piston in the operating cylinder by raising the operating cylinder into a vertical position determined by locating the molding tool at a predetermined height from the back of the book block.

13. The device according to claim 7 wherein:

the operating cylinder for bending over the printed sheets in the lateral regions of the back of the book block is actuated by a predefined pressure of the operating cylinder and the operating cylinder including a piston; and the pressing force is adjustable by a path limitation of the piston in the operating cylinder by raising the operating cylinder into a vertical position determined by locating the molding tool at a predetermined height from the back of the book block.

14. The device according to claim 1 further comprising a second operating cylinder for effecting the pivoting movement of the carriage with the molding tool and wherein the pivoting angle is adjustable.

15. The device according to claim 2 further comprising a second operating cylinder for effecting the pivoting movement of the carriage with the molding tool and wherein the pivoting angle is adjustable.

16. The device according to claim 3 further comprising a second operating cylinder for effecting the pivoting movement of the carriage with the molding tool and wherein the pivoting angle is adjustable.

17. The device according to claim 5 further comprising a second operating cylinder for effecting the pivoting movement of the carriage with the molding tool and wherein the pivoting angle is adjustable.

18. The device according to claim 7 further comprising a second operating cylinder for effecting the pivoting movement of the carriage with the molding tool and wherein the pivoting angle is adjustable.

19. The device according to claim 11 further comprising a second operating cylinder for effecting the pivoting movement of the carriage with the molding tool and wherein the pivoting angle is adjustable.

20. The device according to claim 14, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

21. The device according to claim 15, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

22. The device according to claim 16, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

23. The device according to claim 17, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

24. The device according to claim 18, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

25. The device according to claim 19, wherein the second operating cylinder for effecting pivoting movement of the carriage is controllable in such a manner that the pivoting movement of the carriage with the molding tool is repeatable and coordinated with the lifting from the back of the book block and wherein a return stroke is load-free.

26. The device according to claim 1, wherein the axis of rotation of the molding tool is variable and further comprising intermediate plates for varying the axis of rotation of the tool.

27. The device according to claim 2, wherein the axis of rotation of the molding tool is variable and further comprising intermediate plates for varying the axis of rotation of the tool.

28. The device according to claim 3, wherein the axis of rotation of the molding tool is variable and further comprising intermediate plates for varying the axis of rotation of the tool.

29. The device according to claim 5, wherein the axis of rotation of the molding tool is variable and further comprising intermediate plates for varying the axis of rotation of the tool.

30. The device according to claim 9, wherein the axis of rotation of the molding tool is variable and further comprising intermediate plates for varying the axis of rotation of the tool.

31. The device according to claim 11, wherein the axis of rotation of the molding tool is variable and further comprising intermediate plates for varying the axis of rotation of the tool.

32. The device according to claim 14, wherein the axis of rotation of the molding tool is variable and further comprising intermediate plates for varying the axis of rotation of the tool.

33. The device according to claim 20, wherein the axis of rotation of the molding tool is variable and further comprising intermediate plates for varying the axis of rotation of the tool.

34. The device according to claim 1, wherein the at least one operating cylinder comprises a second operating cylinder for displacing and controlling the molding tool and the operating cylinders being disposed spaced from one another and each being actuated by compressed air.

35. The device according to claim 2, wherein the at least one operating cylinder comprises a second operating cylinder for displacing and controlling the molding tool and the operating cylinders being disposed spaced from one another and each being actuated by compressed air.

36. The device according to claim 3, wherein the at least one operating cylinder comprises a second operating cylinder for displacing and controlling the molding tool and the operating cylinders being disposed spaced from one another and each being actuated by compressed air.

37. The device according to claim 5, wherein the at least one operating cylinder comprises a second operating cylinder for displacing and controlling the molding tool and the operating cylinders being disposed spaced from one another and each being actuated by compressed air.

38. The device according to claim 9, wherein the at least one operating cylinder comprises a second operating cylinder for displacing and controlling the molding tool and the operating cylinders being disposed spaced from one another and each being actuated by compressed air.

39. The device according to claim 11, wherein the at least one operating cylinder comprises a second operating cylinder for displacing and controlling the molding tool and the operating cylinders being disposed spaced from one another and each being actuated by compressed air.

40. The device according to claim 14, wherein the at least one operating cylinder comprises a second operating cylinder for displacing and controlling the molding tool and the operating cylinders being disposed spaced from one another and each being actuated by compressed air.

41. The device according to claim 20, wherein the at least one operating cylinder comprises a second operating cylinder for displacing and controlling the molding tool and the operating cylinders being disposed spaced from one another and each being actuated by compressed air.

42. The device according to claim 26, wherein the at least one operating cylinder comprises a second operating cylinder for displacing and controlling the molding tool and the operating cylinders being disposed spaced from one another and each being actuated by compressed air.

* * * * *